US009310772B2

(12) United States Patent
Konishi et al.

(10) Patent No.: US 9,310,772 B2
(45) Date of Patent: Apr. 12, 2016

(54) METAL STRUCTURE, METHOD OF MANUFACTURING METAL STRUCTURE, SPRING COMPONENT, CHRONOGRAPH COUPLING LEVER FOR TIMEPIECE, AND TIMEPIECE

(71) Applicant: SEIKO INSTRUMENTS INC., Chiba-ken (JP)

(72) Inventors: Miei Konishi, Chiba-ken (JP); Matsuo Kishi, Chiba-ken (JP); Takashi Niwa, Chiba-ken (JP)

(73) Assignee: SEIKO INSTRUMENTS INC. (JP)

( * ) Notice: Subject to any disclaimer, the term of this patent is extended or adjusted under 35 U.S.C. 154(b) by 100 days.

(21) Appl. No.: 14/204,150

(22) Filed: Mar. 11, 2014

(65) Prior Publication Data

US 2014/0269228 A1 Sep. 18, 2014

(30) Foreign Application Priority Data

Mar. 14, 2013 (JP) ..... 2013-051866
Jan. 6, 2014 (JP) ..... 2014-000375

(51) Int. Cl.

| | |
|---|---|
| ***G04B 11/00*** | (2006.01) |
| ***G04B 17/06*** | (2006.01) |
| ***G04F 7/08*** | (2006.01) |
| ***C22C 19/03*** | (2006.01) |
| ***C25D 3/56*** | (2006.01) |
| ***C22F 1/10*** | (2006.01) |
| ***C22F 1/02*** | (2006.01) |

(52) U.S. Cl.

CPC ..... *G04B 17/066* (2013.01); *C22C 19/03* (2013.01); *C22F 1/02* (2013.01); *C22F 1/10* (2013.01); *C25D 3/56* (2013.01); *C25D 3/562* (2013.01); *G04B 11/00* (2013.01); *G04F 7/0842* (2013.01)

(58) Field of Classification Search

CPC ..... G04B 11/00; G04B 17/066; C22C 19/03; C22C 38/08; C25D 3/56; C25D 3/562; C25D 5/02; C25D 5/04; C25D 5/08; C22F 1/10; C22F 1/02; G04F 7/0842

USPC ..... 368/140, 175; 148/426, 555

See application file for complete search history.

(56) References Cited

U.S. PATENT DOCUMENTS

| | | | | | |
|---|---|---|---|---|---|
| 1,974,695 | A | * | 9/1934 | Straumann | 420/94 |
| 2,072,489 | A | * | 3/1937 | Straumann | 420/94 |
| 3,291,474 | A | * | 12/1966 | Clarke | 267/156 |
| 3,795,591 | A | * | 3/1974 | Clauss | 205/260 |
| 3,806,429 | A | * | 4/1974 | Clauss | 205/113 |
| 3,812,566 | A | * | 5/1974 | Clauss | 428/613 |
| 3,905,883 | A | * | 9/1975 | Hanazono et al. | 205/666 |
| 3,969,198 | A | * | 7/1976 | Law et al. | 205/260 |
| 4,102,756 | A | * | 7/1978 | Castellani et al. | 205/82 |
| 4,129,482 | A | * | 12/1978 | Lash | 205/260 |
| 4,179,343 | A | * | 12/1979 | Tremmel | 205/260 |
| 4,231,847 | A | * | 11/1980 | Lui | 205/67 |
| 5,037,669 | A | * | 8/1991 | Woolley | 427/598 |
| 5,932,082 | A | * | 8/1999 | Harris et al. | 205/259 |

(Continued)

*Primary Examiner* — Vit W Miska
(74) *Attorney, Agent, or Firm* — Adams & Wilks

(57) ABSTRACT

A metal structure includes, by mass %, Fe: 10% to 30%; S: 0.005% to 0.2%; and the balance consisting of Ni and unavoidable impurities, in which a maximum grain size of the metal structure is 500 nm or less. The metal structure preferably has one or more of a stress relaxation rate of 10% or less, a lattice constant of 3.535 Å to 3.56 Å, a yield stress of 1500 MPa or more, a Young's modulus of 150 GPa or more and a Vickers hardness of Hv 580 or more.

19 Claims, 9 Drawing Sheets

(56) References Cited

U.S. PATENT DOCUMENTS

| | | | | |
|---|---|---|---|---|
| 7,376,379 | B2 * | 5/2008 | Takahashi et al. | 399/329 |
| 7,726,872 | B2 * | 6/2010 | Levingston | 368/175 |
| 8,394,473 | B2 * | 3/2013 | McCrea et al. | 428/35.8 |
| 8,641,023 | B2 * | 2/2014 | Charbon et al. | 267/180 |
| 2002/0191493 | A1 * | 12/2002 | Hara | 368/140 |
| 2005/0205425 | A1 * | 9/2005 | Palumbo et al. | 204/499 |
| 2006/0037671 | A1 * | 2/2006 | Park | 148/336 |
| 2006/0144485 | A1 * | 7/2006 | Okada et al. | 148/675 |
| 2008/0254310 | A1 * | 10/2008 | Palumbo et al. | 428/551 |
| 2009/0176027 | A1 | 7/2009 | Okada et al. | 427/374.1 |
| 2010/0208555 | A1 * | 8/2010 | Hiraoka et al. | 368/131 |
| 2012/0300596 | A1 * | 11/2012 | Koda et al. | 368/131 |

* cited by examiner

METAL STRUCTURE, METHOD OF MANUFACTURING METAL STRUCTURE, SPRING COMPONENT, CHRONOGRAPH COUPLING LEVER FOR TIMEPIECE, AND TIMEPIECE

TECHNICAL FIELD

The present invention relates to a metal structure, a method of manufacturing a metal structure, a spring component, a chronograph coupling lever for a timepiece, and a timepiece.

Priority is claimed on Japanese Patent Application No. 2013-051866, filed on Mar. 14, 2013 and Japanese Patent Application No. 2014-000375, filed on Jan. 6, 2014, the contents of which are incorporated herein by reference.

BACKGROUND ART

In the related art, a lot of small-sized machine components such as a gear and a spring are mounted on a mechanical timepiece that is one of small-sized precision instrument.

In the related art, these kinds of machine components are mainly manufactured by machining such as punching. However, in recent years, a method of manufacturing these machine components by using electroforming has been adopted. This is because in the electroforming, machining tolerance is smaller in comparison to the machining, and even in a complicated outer shape, manufacturing can be carried out with accuracy. Accordingly, electroforming is a particularly appropriate method in a case of manufacturing fine and precise machine components.

As a method of manufacturing a small-sized component with high dimensional accuracy, for example, a LIGA technology in which photolithography (Lithographie) and electroplating (Galvanoformung) are combined is disclosed (For example, Non-Patent Document 1).

Here, among small-sized machine components that constitute a mechanical timepiece, a component such as a chronograph coupling lever spring has a spring function (hereinafter, referred to as a "spring component"). In this spring component, excellent fatigue properties and high strength are required for improving excellent connectivity with other components. In addition, since the spring component controls connection with other components by repeating loading and unloading, a property for restoring the original shape during unloading are required. That is, properties capable of reducing a permanent strain amount that remains as deformation after unloading, that is, stress relaxation resistance properties are required for the spring component.

PRIOR ART DOCUMENT

Non-Patent Document

[Non-Patent Document 1] Journal of the Surface Finishing Society of Japan, Vol. 55 (2004), No. 4, pp. 226-231

SUMMARY OF THE INVENTION

Problem to be Solved by the Invention

In recent years, Ni has been widely used as a representative electroforming material, and a structure consists of Ni has been used in a spring component.

However, the present inventors have investigated the stress relaxation resistance properties of a spring component manufactured by Ni electroforming. From the investigation, the present inventors have found that even at a load equal to or less than a yield stress, that is, a load in an elastic deformation region, it is difficult to obtain excellent stress relaxation resistance properties. That is, the present inventors found that the spring component manufactured by the Ni electroforming has a problem in that even when a spring unit is unloaded after deformed for a long time, the spring component does not return to the original shape. In addition, in a device that uses these spring components, there is a concern that malfunction may occur.

The invention has been made in consideration of the above-described circumstances, and an object thereof is to provide a metal structure which is highly precise and is capable of suppressing a stress relaxation rate, a method of manufacturing a metal structure, a spring component, a chronograph coupling lever for a timepiece, and a timepiece.

Means for Solving the Problems

The present inventors have made a thorough investigation to solve the above-described problems, and the present inventors have found that when manufacturing is performed with Ni—Fe alloy electroforming, and heat treatment conditions after electroforming, particularly, a heat treatment temperature and a heat treatment time are optimized, a stress relaxation rate can be greatly reduced.

In addition, the present inventors have found that when the heat treatment conditions are optimized, coarsening of grains is suppressed and thus mechanical properties such as a Young's modulus, a yield stress, and Vickers hardness can be improved.

The present invention has been made based on the above-described findings and the gist of the present invention is as follows.

[1] A metal structure according to an aspect of the present invention includes, by mass %, Fe: 10% to 30%; S: 0.005% to 0.2%; and the balance consisting of Ni and unavoidable impurities, in which a maximum grain size of the metal structure is 500 nm or less.

[2] In the metal structure according to [1], a lattice constant of the metal structure may be 3.535 Å to 3.56 Å.

[3] In the metal structure according to [1] or [2], a stress relaxation rate of the metal structure may be 10% or less.

[4] In the metal structure according to any one of [1] to [3], a yield stress of the metal structure may be 1500 MPa or more and a Young's modulus of the metal structure may be 150 GPa or more.

[5] In the metal structure according to any one of [1] to [4], a Vickers hardness of the metal structure may be Hv 580 or more.

[6] A method of manufacturing a metal structure according to another aspect of the present invention includes forming by an electroforming the metal structure including, by mass %, Fe: 10% to 30%; S: 0.005% to 0.2%; and the balance consisting of Ni and unavoidable impurities, and performing a heat treatment to the metal structure under conditions in which a heat treatment temperature is 140° C. to 350° C. and a Larson-Miller parameter is in a range of 7500 to 9500.

[7] In the method of manufacturing a metal structure according to [6], the heat treatment temperature may be equal to or higher than 140° C. and lower than 275° C.

[8] A spring component according to still another aspect of the present invention includes, the spring component is formed by the metal structure according to any one of [1] to [5].

[9] A chronograph coupling lever for a timepiece according to still another aspect of the present invention includes, the chronograph coupling lever for a timepiece is formed by the spring component according to [8].

[10] A timepiece according to still another aspect of the present invention, the timepiece which uses the spring component according to [8] as an assembling component thereof.

[11] A timepiece according to still another aspect of the present invention, the timepiece which uses the chronograph coupling lever for a timepiece according to [9] as an assembling component thereof.

Effects of Invention

According to the present invention, it is possible to provide a metal structure being capable of greatly reducing a stress relaxation rate by defining heat treatment conditions, particularly, a Larson-Miller parameter after electroforming.

In addition, when heat treatment conditions are optimized, coarsening of grains is suppressed in comparison to Ni-electroforming of the related art and thus mechanical properties such as a Young's modulus, a yield stress, and Vickers hardness can be improved.

In addition, according to the method of manufacturing a metal structure of the present invention, a manufacturing technology of a highly precise small-sized component is applicable to a spring component, and thus accuracy of a device (for example, a timepiece), which uses the highly precise component, is also improved. In addition, since the method of manufacturing a metal structure according to the present invention adopts electroforming, the metal structure can be designed more flexibly in shape. Therefore, the method makes a mechanism or miniaturization, which is not attained by a material in the related art, possible.

DESCRIPTION OF EMBODIMENTS

Hereinafter, embodiments of the present invention will be described.

(Metal Structure)

First, a metal structure according to the present invention will be described.

The metal structure of the present invention includes, by mass %, Fe: 10% to 30%; S: 0.005% to 0.2%; and the balance consisting of Ni and unavoidable impurities, in which a maximum grain size is 500 nm or less.

In addition, a lattice constant of the metal structure is preferably in a range from 3.535 Å to 3.56 Å to reduce a stress relaxation rate. Further, it is effective for the lattice constant of the metal structure after a heat treatment to be 99.95% or less of a lattice constant as electroformed to further increase the effect of reducing the stress relaxation rate.

Hereinafter, a configuration of a metal structure according to the embodiment will be described.

(Fe: 10% to 30%, by mass %)

From the examination of the present inventors, present inventors have found that when Fe content in the metal structure is in a range from 10% to 30%, a stress relaxation rate of the metal structure can be reduced.

Hereinafter, details of the examination, results of the examination and a reduction mechanism of the stress relaxation rate by Fe will be described.

Figure 1:
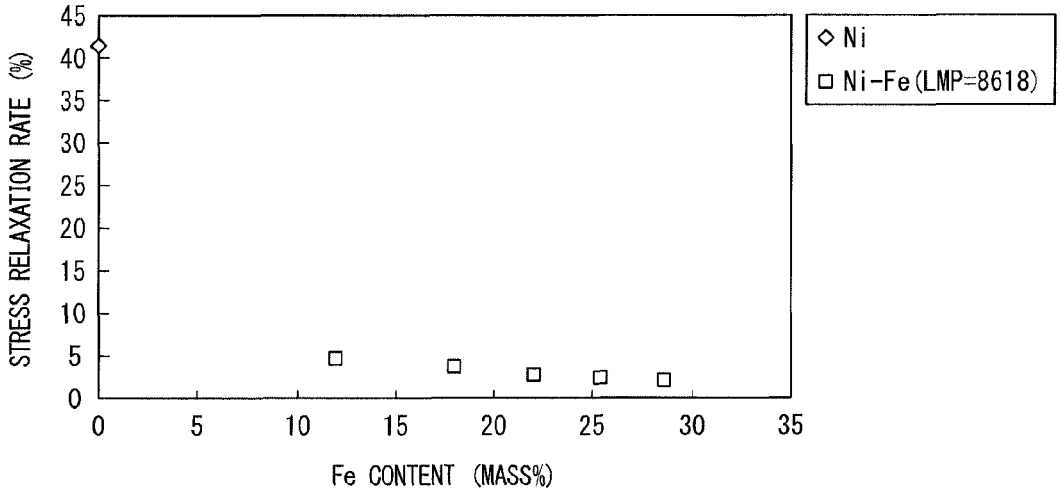
FIG. 1 is a graph illustrating a relationship between a Fe content and a stress relaxation rate in a metal structure.

FIG. 1 shows a graph illustrating a relationship between Fe content (by mass %) and stress relaxation rate in the metal structure. In the graph, datapoints of Ni-electroforming represents results of "Condition 0" in the following Table 1, and datapoints of Ni—Fe electroforming represent results of using metal structures in which Fe content is varied when a heat treatment temperature after electroforming is 250° C., a heat treatment time is 3 hours and a Larson-Miller parameter (LMP) is 8618.

In addition, the stress relaxation rate may be obtained by the following Expression (2) conforming to "Method of stress relaxation test for the plates for springs" of JIS B2712 2006. With regard to test conditions, deformation during 48 hours can be applied with a constant displacement amount in a thermostatic bath set to 80° C. Details of the LMP will be described later.

$$\text{Stress relaxation rate (\%)}=(\delta_t/\delta_0)\times 100 \quad (2)$$

In addition, in Expression (2), $\delta_0$ represents an initial strain (mm) and $\delta_t$ represents a permanent strain (mm) that remains after releasing a load.

As can be seen from Expression (2), the larger the permanent strain is (the smaller a restoring force is), the higher the stress relaxation rate becomes, and thus stress relaxation resistance properties deteriorate.

From the graph of FIG. 1, in a case of the Ni electroforming in the related art, the stress relaxation rate exhibits a high value exceeding 40%. In contrast, in a case of the Ni—Fe electroforming, it can be seen that the stress relaxation rate decreases along with an increase in the Fe content and thus it is possible to suppress the stress relaxation rate to 10% or less.

As described above, in the metal structure according to the embodiment, the Fe content is set to 10% to 30%, by mass %. In addition, by mass %, the Fe content is preferably 15% or more, and more preferably 20% or more so as to further reduce the stress relaxation rate. In addition, when the upper limit of the Fe content is 30%, by mass %, it is possible to exhibit an effect of sufficiently reducing the stress relaxation rate. However, from the viewpoint of productivity and saturability of the effect of reducing the stress relaxation rate, the upper limit may be 28% or less, by mass.

Hereinafter, a reduction mechanism of the stress relaxation rate by adding Fe will be described.

As is the case with the Ni electroforming in the related art, the present inventors have considered the reason that a shape defect is caused by remaining as a permanent strain even in a low load equal to or less than a yield stress along with an increase of stress relaxation rate is deformation (slipping) of a lattice defect generated in a grain boundary. In addition, from an examination, the present inventors have found that occurrence of the stress relaxation at an early stage is affected by an intragranular lattice defect and the like rather than an intergranular lattice defect.

Then, the present inventors have found that generation of the slipping can be suppressed by regularizing of intragranular atomic arrangement and by reducing of intragranular lattice defect so as to minimize an intragranular slipping.

A Ni—Fe alloy takes a form in which Fe solid-solutes in Ni and Fe completely solid-solutes in a crystal lattice of Ni up to approximately 30%, by mass %. In a state as electroformed before a heat treatment, since arrangement of Fe atoms solid-soluted in the crystal lattice of Ni is random (irregular), it is in a state in which the slip is likely to occur by facility of migration of atoms due to many slipping directions caused by the crystal lattice of Ni being fcc. Accordingly, when the heat treatment is performed after electroforming so as to arrange Fe atoms at a regular and stable position, it is possible to suppress generation of the slipping.

Particularly, when Ni:Fe (ratio by mass %) is 3:1, in a crystal lattice of Ni which is a face-centered cubic (fcc) lattice, a state in which Fe is arranged at each vertex of fcc becomes regular arrangement. In this manner, a state in which Fe is arranged at each vertex of fcc represents a state in which a Ni atom and an Fe atom, which have atom sizes different from each other, are alternately arranged when viewed from a (111) plane that is a slipping plane. That is, a step difference generates between the Ni atom and the Fe atom and this step difference is regularly lined up, and thus it is possible to realize a state in which slipping due to atom migration is not likely to occur. That is, as it becomes close to a composition in which Ni:Fe (ratio by mass %) is 3:1, Fe is arranged at each vertex of fcc, a slipping plane becomes rough due to the step difference, and as a result, it is possible to prevent plastic deformation from generating.

In addition, as a described on the assumption that the state in which Fe is arranged at each vertex of fcc becomes regular when the ratio by mass % between Ni and Fe is 3:1, but accurately, the regular arrangement is obtained when a ratio between Ni and Fe by atom % is 3:1. Therefore, an assumption of the ratio by atom % the ratio by mass % may be possible because Ni and Fe are elements having a similar atomic weight.

(S: 0.005% to 0.2%, by mass %)

In the metal structure according to the embodiment, by mass %, 0.005% to 0.2% of S is contained. The S is derived from nickel sulfamate tetrahydrate, ferrous sulfamate pentahydrate, a surfactant, a primary brightening agent, and the like in an electroforming bath during performing an electroforming process. In the electroforming process, metal ions react in a negative electrode and thus metal precipitates. However, such as non-metal ions and the brightening agent, which adhere to a surface of the negative electrode, are also trapped in an electroformed material. Accordingly, elements such as S, O and H, which are contained in a bath composition and are typically regarded as unavoidable impurities, are eutectoid. That is, in the embodiment, it is possible to control the S content in the metal structure by adjusting the composition of the nickel sulfamate tetrahydrate, the ferrous sulfamate pentahydrate, the surfactant, and the like.

In addition, S is an impurity, and the less the content is, the more preferable from the viewpoints of properties of the metal structure. Accordingly, the upper limit of the S content is preferably set to 0.1%, by mass %. On the other hand, when the S content is excessively reduced, there is a concern that an increase in the electroforming cost may be caused. Therefore, the lower limit of the S content is preferably set to 0.01% by mass or more.

As described above, the electroformed body according to the embodiment has a composition including 10% to 30% of Fe and 0.005% to 0.2% of S, by mass %, and the balance consisting of Ni and unavoidable impurities. However, trace elements may be included in a range not deteriorating the effect of the present invention.

In addition, the maximum grain size of the metal structure according to the embodiment is 500 nm or less.

The maximum grain size has a great effect on mechanical properties such as a yield stress and Vickers hardness. When the maximum grain size is made to be small, that is, when coarsening of the grain size is suppressed, it is possible to reduce the stress relaxation rate while maintaining the above-described mechanical properties. To exhibit these effects, it is important for the maximum grain size of the metal structure to be 500 nm or less. In addition, the maximum grain size of the metal structure is more preferably 400 nm or less, and still more preferably 300 nm or less. On the other hand, from the viewpoint of having the above-described effects, the smaller the grain size is, the more preferable. In the embodiment, the lower limit of the maximum grain size is not particularly limited, but substantially, the maximum grain size is 10 nm or more.

In addition, the lattice constant of the metal structure is preferably set in a range from 3.535 Å to 3.56 Å so as to reduce the stress relaxation rate of the metal structure.

Figure 2:
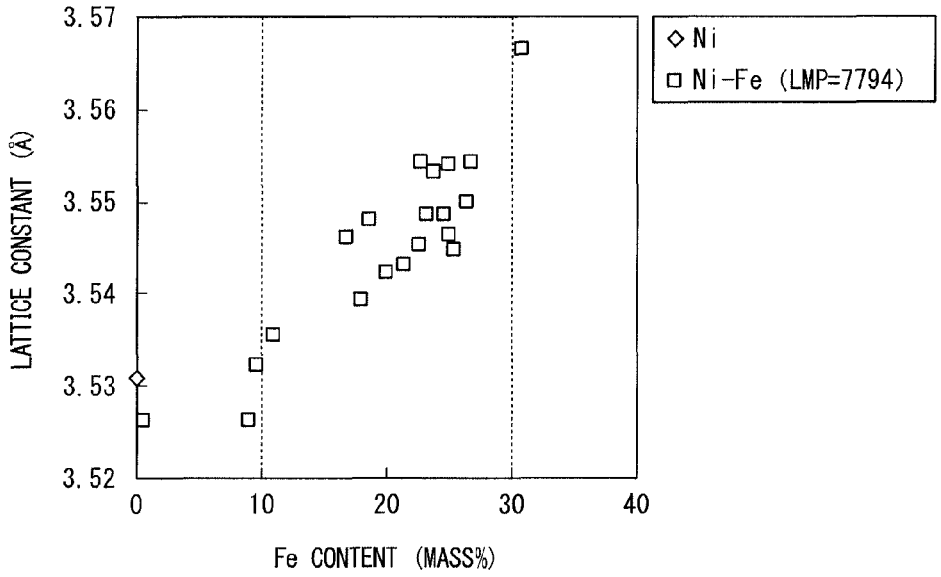
FIG. 2 is a graph illustrating a relationship between Fe content (mass %) and lattice constant (Å) in a metal structure.
Figure 3:
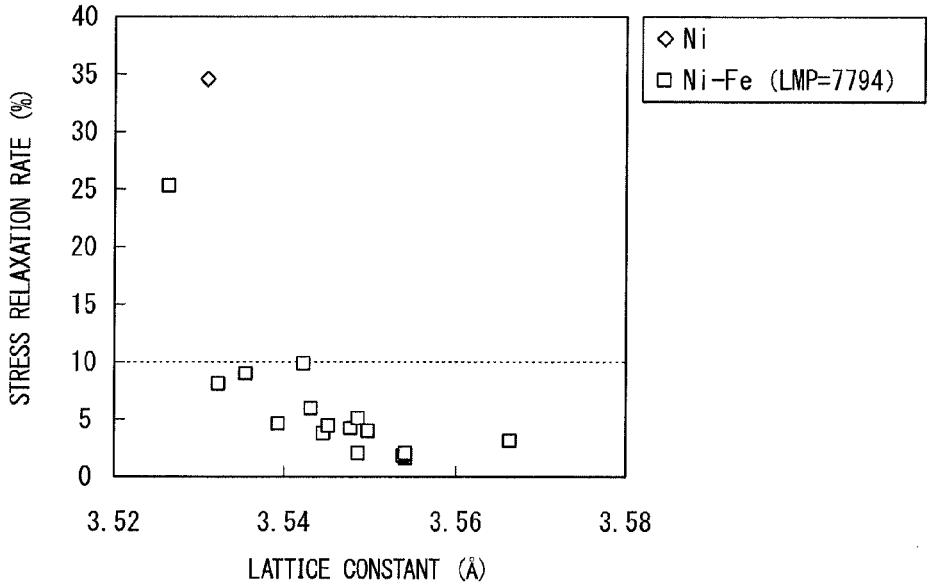
FIG. 3 is a graph illustrating a relationship between lattice constant (Å) and stress relaxation rate (%) in a metal structure.

FIG. 2 shows a graph illustrating a relationship between the Fe content (by mass %) and the lattice constant (Å) in the metal structure. In addition, FIG. 3 shows a graph illustrating a relationship between the lattice constant (Å) and the stress relaxation rate (%) in the metal structure. Datapoints of Ni-electroforming represents results of "Condition 0" in the following Table 1, and datapoints of Ni—Fe electroforming represent results of using metal structures in which Fe content is varied when a heat treatment temperature after electroforming is 200° C., a heat treatment time is 3 hours and a LMP is 7794. In addition, the lattice constant is obtained from an X-ray diffraction pattern of each metal structure that is obtained.

From the graph of FIG. 2, in a case of the metal structure obtained by the Ni—Fe electroforming, it can be seen that along with an increase in the Fe content, the lattice constant tends to increase. This is considered to be because a Ni—Fe alloy takes a form in which Fe solid-solutes in Ni. That is, in a case of the metal structure obtained by the Ni—Fe electroforming, the Fe element larger than the Ni element solid-solutes in the crystal lattice of Ni. Accordingly, it is considered that as the Fe content in the metal structure increases, the lattice constant also increases.

In addition, from the graph of FIG. 3, it can be seen that along with an increase in the lattice constant, the stress relaxation rate tends to decrease.

From the above, the lattice constant of the metal structure according to the embodiment is preferably set in a range from 3.535 Å to 3.56 Å.

In addition, the present inventors have conducted an additional examination of the lattice constant of the Ni—Fe alloy (metal structure). From the examination, the present inventors have found that when it becomes close to a state in which Fe is regularly arranged in the Ni crystal lattice as described above, it is possible to make the lattice constant smaller in comparison to a state as electroformed (Fe atoms are randomly arranged). That is, from the state in which the Fe atoms are randomly arranged, the Fe atoms are regularly arranged due to a heat treatment, and thus it is considered that it is possible to make the lattice constant small.

As described above, when the heat treatment is performed to the metal structure so as to convert the atom arrangement from a state that atom arrangement is irregular to a state that atom arrangement is regular, and thus a lattice state in which Fe solid-solutes in the Ni crystal lattice can be stable and strong, and as a result, it is possible to reduce the stress relaxation rate.

The lattice constant of the metal structure after the heat treatment is preferably 99.95% or less with respect to the lattice constant as electroformed so as to have the effect of reducing the stress relaxation rate.

Next, the mechanical properties of the metal structure will be described.

The stress relaxation rate of the metal structure according to the embodiment is preferably 10% or less. As described above, when the composition of the metal structure is set to include 10% to 30% of Fe and 0.005% to 0.2% of S and the maximum grain size is set to 500 nm or less, it is possible to greatly reduce the stress relaxation rate. In addition, the stress relaxation rate is preferably 5% or less.

Further, when the lattice constant of the metal structure is set in a range from 3.535 Å to 3.56 Å, and the lattice constant of the metal structure after the heat treatment is 99.95% or less with respect to the lattice constant as electroformed, it is possible to further reduce the stress relaxation rate.

In addition, from the viewpoint of securing excellent fatigue properties and high strength, the yield stress of the metal structure according to the embodiment is preferably 1500 MPa or more and the Young's modulus is preferably 150 GPa or more. More preferably, the yield stress is 1600 MPa or more and the Young's modulus is 160 GPa.

In addition, the Vickers hardness of the metal structure according to the embodiment is preferably Hv 580 or more. For example, in a case of applying the metal structure to machine components and the like, high strength is required. Accordingly, it is preferable to secure Hv 580 or more of the Vickers hardness of the metal structure, and more preferably Hv 600 or more.

(Method of Manufacturing Metal Structure)

Next, a method of manufacturing the above-described metal structure will be described.

The method of manufacturing the metal structure according to the embodiment includes forming by electroforming the metal structure including, by mass %, Fe: 10% to 30%; S: 0.005% to 0.2%; the balance consisting of Ni and unavoidable impurities; and performing a heat treatment to the metal structure under conditions in which a heat treatment temperature is 140° C. to 350° C. and a Larson-Miller parameter is in a range of 7500 to 9500. In addition, form the viewpoint of compatibility of reduction of the stress relaxation rate and the high strength, the heat treatment temperature is preferably equal to or higher than 140° C. and lower than 275° C.

Hereinafter, respective conditions in the manufacturing method according to the embodiment will be described in detail with reference to the attached drawings.

Figure 4:
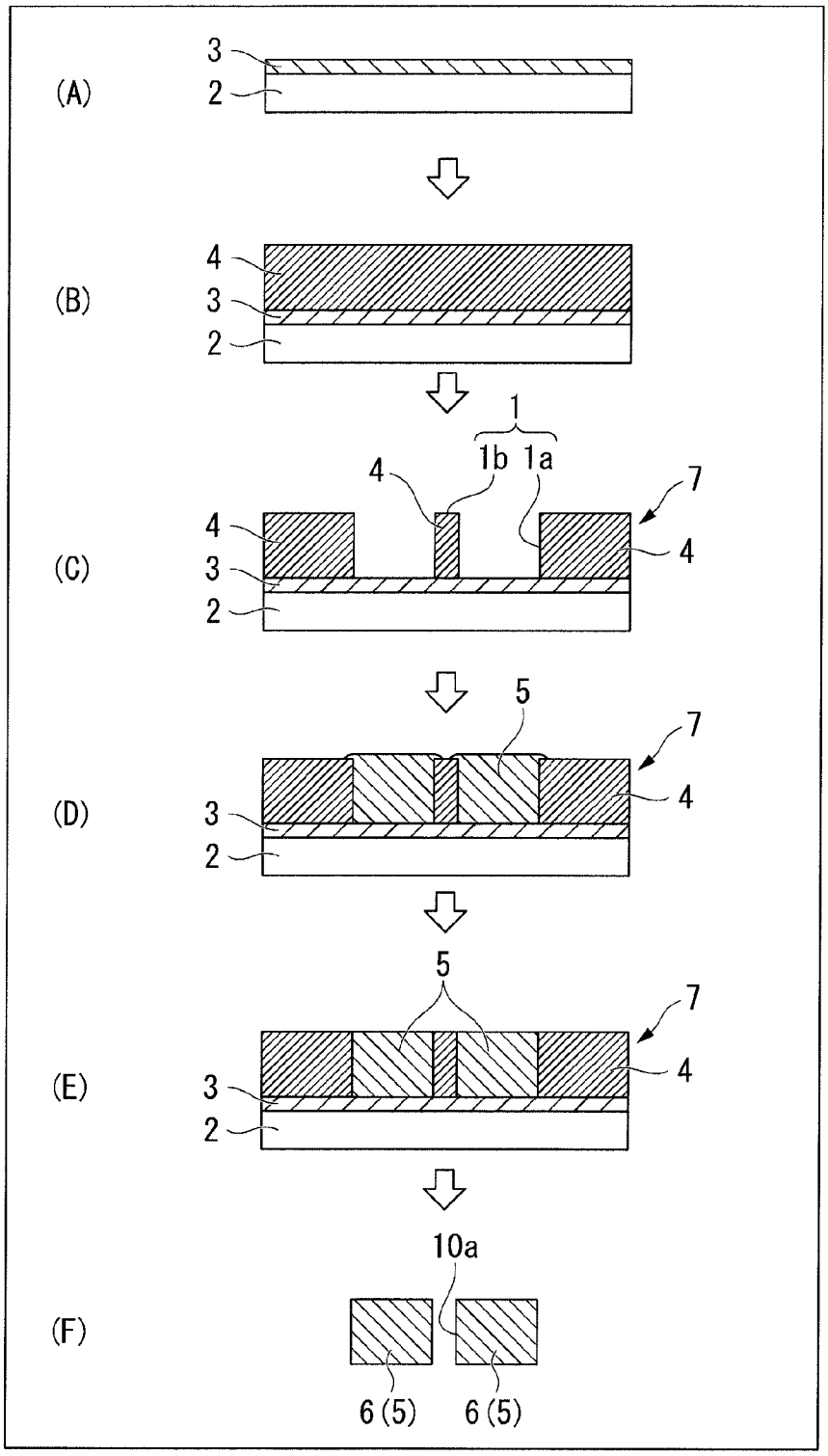
FIG. 4 is a flow chart (schematic cross-sectional view of a metal structure) illustrating a method of manufacturing a metal structure.

FIG. 4A shows a view illustrating a process of forming an electrode for electroforming.

First, as shown in FIG. 4A, an electrode 3 that is a negative electrode is formed on a substrate 2 in an electroforming process.

For the substrate 2, silicon, quartz, and sapphire, various materials such as stainless steel and Ti may be used. As a material of the electrode 3, Cu, Au, Cr, Ti, and the like may be used. In addition, when a metal material is adopted as the substrate 2, the electrode 3 may not be formed. In this case, the substrate 2 can function as the electrode (negative electrode) for the electroforming.

The thickness of the substrate 2 is preferably 100 μm to 1 mm so as to be easily worked in subsequent processes. In addition, the thickness of the electrode 3 is preferably 10 nm or more from the viewpoint of securing stable electrical conduction and necessary minimum strength in the following electroforming process. On the other hand, when the thickness of the electrode 3 is too large, there is a concern that peeling off may occur due to action of a stress or it needs time for film formation. Accordingly, the thickness of the electrode 3 is preferably 10 μm or less.

FIG. 4B shows a view illustrating a process of forming a resist.

Next, as shown in FIG. 4B, a photoresist 4 is formed on the electrode 3. The photoresist 4 may be a negative type or a positive type, and may be formed by using a spin coating method or a dip coating method. In addition, when a dry film resist is used as a photoresist, the photoresist 4 may be formed by using a laminating method.

The thickness of the photoresist 4 is equal to or more than the thickness of a metal structure 6 (refer to FIG. 4F) which is formed in a subsequent process.

Hereinafter, the following case when a negative type is the used as photoresist will be described.

FIG. 4C shows a view illustrating a development process.

Next, as shown in FIG. 4C, first, a photomask (not shown) having an outer pattern of the metal structure 6 (refer to FIG. 4F) to be formed in a subsequent process is used, and the photoresist 4 is irradiated with ultraviolet rays, thereby curing the photoresist 4 other than an area in which an electroformed material is allowed to precipitate in a subsequent electroforming process. Subsequently, the photoresist 4 (of the area in which the electroformed material is allowed to precipitate) which is not cured is removed so as to form an electroforming mold 7 having a pattern unit 1 to form an outer shape of the metal structure 6 (refer to FIG. 4F). The pattern unit 1 that is shown has a concave 1*a* to form the outer shape of the metal structure 6 and a column 1*b* which is stood from a bottom surface of the concave 1*a* to form a penetration hole 10*a* (refer to FIG. 4F) in the metal structure 6. In addition, although not being shown, it is assumed that plurality of the pattern units 1 are formed in a matrix direction in the electroforming mold 7.

In addition, as the method of forming the electroforming mold 7 in the embodiment, a description has been made with reference to the process of forming the electrode for electroforming to the development process as shown in FIG. 4A to FIG. 4C. However, the present invention is not limited thereto, and a known method may be adopted as the method of forming the electroforming mold 7.

FIG. 4D shows a view illustrating an electroforming process.

Next, as shown in FIG. 4D, the electroforming mold 7 is set in an electroforming device 20 (refer to FIG. 5A) to form an electroformed material 5 formed from a Ni—Fe alloy on the electrode 3 that is exposed.

Hereinafter, the electroforming process using the electroforming device 20 shown in FIG. 5A and FIG. 5B will be described in detail.

Figure 5A:
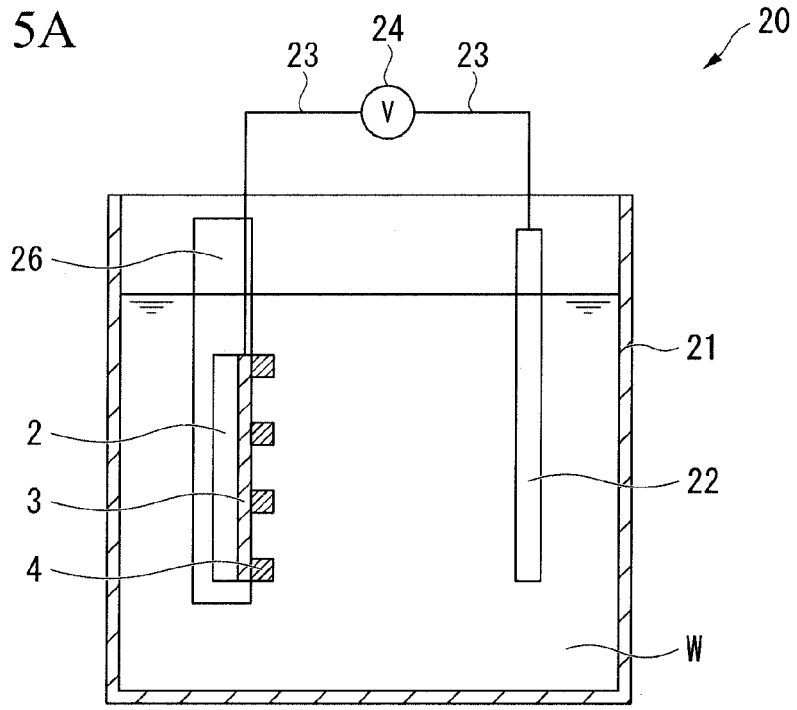
FIG. 5A is a schematic configuration view of an electroforming device.
Figure 5B:
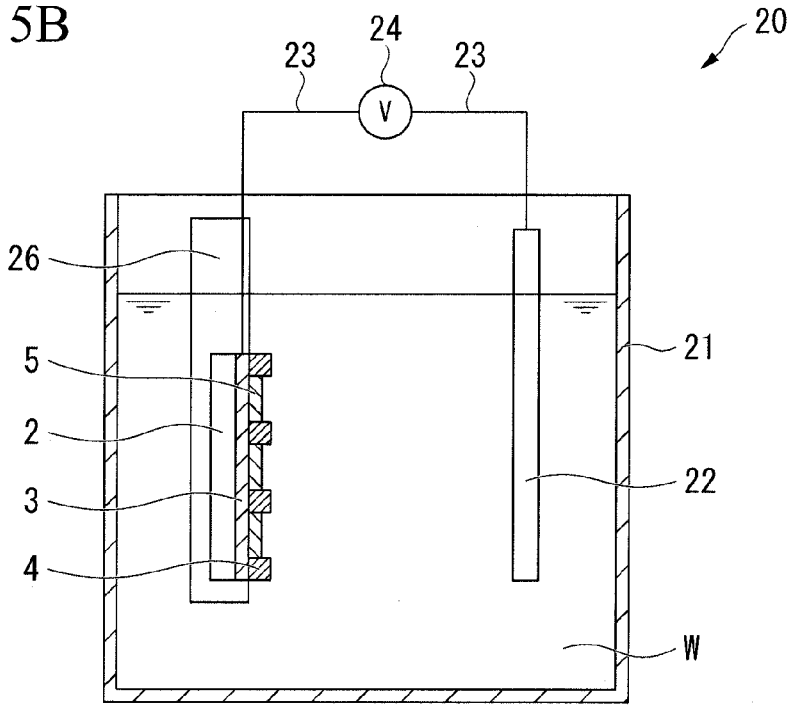
FIG. 5B is a schematic configuration view of an electroforming device.

FIG. 5A and FIG. 5B show schematic configuration views of the electroforming device 20.

As shown in FIG. 5A, the electroforming device 20 includes an electroforming tank 21 in which an electroforming liquid W containing Ni ions and Fe ions is stored, a positive electrode 22 that is immersed in the electroforming liquid W, and a power supply unit 24 that is connected to the positive electrode 22 and an electrode (negative electrode) 3 that is formed in the electroforming mold 7 through an electrical interconnection 23.

Since the electroformed material is formed from a Ni—Fe alloy, as the electroforming liquid W according to the embodiment, an electroforming liquid containing Ni ions and Fe ions is used. In addition, in the embodiment, it is important to precipitate an electroformed body having a composition containing 10% to 30% of Fe and 0.005% to 0.2% of S, the balance consisting of Ni and unavoidable impurities. Accordingly, composition adjustment or mixing of the electroforming liquid W is performed to obtain the above-described composition.

Nickel sulfate, nickel chloride, nickel sulfamate, and the like may be used as a Ni source, and ferrous sulfate, ferrous chloride, ferrous sulfamate, and the like may be used as a Fe source. In addition, boric acid, acetic acid, citric acid, and the like may be added as a buffering agent. In addition, a sulfuric acid ester based surfactant, an alkyl sulfonic acid based surfactant, and the like may be added as a pit prevention agent. In addition, sodium saccharin, sodium naphthalenesulfonate, and para-toluene sulfonamide may be added as a primary brightening agent, and butynediol, formaldehyde, and the like may be added as a secondary brightening agent. In addition, an antioxidant such as ascorbic acid and isoascorbic acid, or a complexing agent such as malonic acid, tartaric acid, and succinic acid may be added.

Hereinafter, preferred examples of an electroforming bath composition and electroforming conditions will be described. However, the bath composition and the conditions may be appropriately changed in a range not deteriorating the effect of the present invention, that is, in an electroforming bath composition and electroforming conditions which allow an electroformed body containing 10% to 30% of Fe and 0.005% to 0.2% of S to precipitate, and the present invention is not limited to the following examples.

(Electroforming Bath Composition)

Nickel sulfamate tetrahydrate: 200 g/L to 300 g/L

Nickel chloride hexahydrate: 2 g/L to 10 g/L

Ferrous sulfamate pentahydrate: 5 g/L to 50 g/L

Boric acid: 10 g/L to 50 g/L

Surfactant: 0.1 g/L to 10 g/L

Primary brightening agent: 1 g/L to 15 g/L

Secondary brightening agent: 0.05 g/L to 5 g/L

Antioxidant: 0.1 g/L to 10 g/L pH: 2 to 4

Bath temperature: 40° C. to 60° C.

(Electroforming Conditions)

Negative electrode current density: 1 A/dm$^2$ to 10 A/dm$^2$

An electroforming process is performed by using the electroforming device 20 configured as described above.

First, in a state of being mounted to a jig 26, the electroforming mold 7 provided with the electrode (negative electrode) 3 is immersed in the electroforming liquid W stored in the electroforming tank 21, and then the power supply unit 24 is allowed to operate to apply a voltage between the positive electrode 22 and the negative electrode 3. In this case, Ni ions and Fe ions in the electroforming liquid W migrate in the liquid toward the side of negative electrode 3, and precipitate as a Ni—Fe alloy on a surface of the negative electrode 3 as shown in FIG. 5A and FIG. 5B and further grows, whereby the electroformed body 5 is obtained. In the embodiment, the electroformed body 5 is formed on an entire main surface (inside the concave 1*a* and on a surface of the resist 4) of the electroforming mold 7.

The electroformed body 5 having a thickness larger than the thickness of the metal structure 6 is precipitated. That is, since the depth of the concave 1*a* is equal to the thickness of the metal structure 6, the Ni—Fe alloy is allowed to grow until at least the concave 1*a* of the electroforming mold 7 is buried with the electroformed body 5. However, in a case where a grinding and polishing process shown in FIG. 4E is omitted in the subsequent process, the electroformed body 5 is allowed to precipitate to have the same thickness as the metal structure 6.

FIG. 4E shows a view illustrating the grinding and polishing process. The electroformed body 5 obtained in the above-described electroforming process is ground to have the thickness of the metal structure 6, and a surface of the electroformed body 5 is polished and is finished to have a mirror surface.

Next, as shown in FIG. 4E, the grinding and polishing process are performed. Specifically, the electroforming mold 7 in which the electroformed body 5 is formed is taken out from the electroforming tank 21 (refer to FIG. 5A and FIG. 5B), and the electroformed body 5 obtained in the electroforming process is ground in order for electroforming mold 7 to have the thickness dimension of the metal structure 6. In the embodiment, the grinding is performed in order for the electroformed body 5 formed on a surface of the electroforming mold 7 to be removed (in order for the electroformed body 5 formed inside the concave 1*a* to remain). In addition, in the embodiment, it is preferable that the electroformed body 5 is ground to have the thickness of the metal structure 6 and the surface of the electroformed body 5 is finished by polishing to a mirror surface.

FIG. 4F shows a view illustrating a process of taking out the electroformed body.

Finally, as shown in FIG. 4F, in the process of taking out the electroformed body, the electroformed body 5 remaining inside the pattern unit 1 (concave 1*a*) of the electroforming mold 7 is taken out from the electroforming mold 7. Specifically, the substrate 2, the electrode 3, and the photoresist 4 are removed to take out the electroformed body 5. However, the removal method is not particularly limited, and for example, the removal may be performed by etching. In addition, a physical force may be applied to take out the electroformed body 5. According to this, it is possible to obtain the metal structure 6 constituted by the electroformed body 5 formed from the Ni—Fe alloy.

In the embodiment, after the metal structure 6 is taken out from the electroforming mold 7, a heat treatment is performed with respect to the metal structure 6.

Specifically, the metal structure 6 that is obtained is subjected to a heat treatment under conditions in which a heat temperature is 140° C. to 350° C., and a Larson-Miller parameter is in a range of 7500 to 9500. A heat treatment device is not particularly limited, and for example, a heating furnace that is used in a typical heating process may be used. In addition, with regard to an atmosphere during the heat treatment, the heat treatment is preferably performed in vacuum or an inert gas such as Ar and $N_2$ from the viewpoint of preventing surface oxidation of the metal structure 6.

Hereinafter, the reason why the heat treatment conditions are limited will be described.

Generally, the heat treatment of a metal structure obtained by electroforming is performed for improvement of strength, removal of residual stress, adjustment of a grain size, and the like. That is, to obtain a metal structure having desired properties, it is important to optimize the heat treatment conditions, particularly, the heat treatment temperature and the heat treatment time.

Therefore, the present inventors have made a thorough investigation with respect to the heat treatment conditions which are capable of greatly reducing the stress relaxation rate in the metal structure which is formed from the Ni—Fe alloy and is obtained by the electroforming, which are capable of suppressing coarsening of grains in comparison to Ni electroforming of the related art, and which are capable of improving mechanical properties such as the YoungAEs modulus, the yield stress, and the Vickers hardness. As a result, the present inventors have found that even when trying to define respective appropriate ranges of the heat treatment temperature and the heat treatment time by a matrix thereof to find the appropriate ranges of the heat treatment temperature and the heat treatment time, behavior of the stress relaxation rate that is obtained is complex, and thus it is difficult to optimize the conditions only with the heat treatment temperature and the heat treatment time. Therefore, the present inventors have collected results, which are obtained under various conditions of the heat treatment temperature and the heat treatment times, in terms of the stress relaxation rate, and they have found that it is possible to define the conditions with the Larson-Miller parameter (LMP).

A Larson-Miller method is one of heat acceleration test methods of estimating long-term properties from short-term test results. In addition, the Larson-Miller parameter P can be obtained by the following Expression (1). In addition, in Expression (1), T represents a test temperature (K), C represents a material constant, and t represents a test time (hour).

$$P=T\times(C+\log(t)) \quad (1)$$

The present inventors have found that when performing the heat treatment under conditions in which the Larson-Miller parameter P becomes in a range of 7500 to 9500 in addition to definition of an appropriate range of the heat treatment temperature, it is possible to greatly improve mechanical properties including the stress relaxation rate of the metal structure.

Here, the material constant C is different depending on a material. Generally, metal is set to 20 and solder is set to 10 in many cases. However, documents, findings, and the like which define the material constant C of the electroforming material are not disclosed. Accordingly, in the present invention, the material constant C is obtained from a master curve of the stress relaxation rate which is created by setting the LMP to the horizontal axis and by setting the stress relaxation rate (%) to the vertical axis. As a result, in the case of the metal structure formed from the Ni—Fe alloy according to the present invention, when the material constant C is set to 16, the matching property of the master curve is sufficient. Accordingly, in the present invention, the Expression of the Larson-Miller parameter P is calculated by setting the material constant C to 16.

In the embodiment, the heat treatment is performed under conditions in which the Larson-Miller parameter (LMP) is in a range of 7500 to 9500 and the heat treatment temperature is in a range of 140° C. to 350° C. When the heat treatment is performed under the conditions in which the LMP is 7500 or more, the stress relaxation rate can be reduced, and the Young's modulus and the yield stress can be improved. On the other hand, when the heat treatment is performed under conditions in which the LMP is excessively large, there is a concern that the yield stress and the Vickers hardness may deteriorate, and thus the LMP is 9500 or less. In addition, the LMP is preferably in a range from 8000 to 9500 so as to obtain a stable high Young's modulus.

In addition, in the manufacturing method of this embodiment, the heat treatment temperature is in a range of 140° C. to 350° C. However, from the viewpoint of compatibility between reduction of the stress relaxation rate and high strength, the heat treatment temperature is preferably set to a temperature equal to or higher than 140° C. and lower than 275° C.

The present inventors have conducted an examination of a relationship between the heat treatment conditions and the Vickers hardness in detail. From the examination, the present inventors have obtained the following new finding. With regard to the metal structure obtained by the Ni—Fe electroforming, even when the LMP is in a range of 7500 to 9500, when the treatment is performed at a high temperature, the Vickers hardness tends to deteriorate.

Hereinafter, a decrease mechanism of the Vickers hardness due to the high-temperature heat treatment will be described.

As described above, even in the same LMP condition, when the heat treatment temperature is high, the Vickers hardness tends to decrease. This is considered to be caused by sulfur brittleness.

In the Ni electroforming in the related art, it is known that a decrease in hardness due to the sulfur brittleness is exhibited with a heat treatment of 215° C. or higher, and thus the decrease in hardness is considered to be because a slight amount of sulfur diffuses along a grain boundary of Ni and is coupled with Ni, and decreases a cohesive force between grains. On the other hand, in the Ni—Fe electroforming, Fe blocks the coupling between Ni and S, and thus it is considered that when the heating is not performed at a temperature exceeding 275° C. that is higher than the case of the Ni electroforming, the sulfur brittleness is not generated.

From the above, the heat treatment temperature after the electroforming is preferably a temperature equal to or higher than 140° C. and lower than 275° C.

In addition, it is considered that the stress relaxation is affected by a defect inside a grain, and thus it is considered that the sulfur brittleness that is a phenomenon occurring in a grain boundary does not have an effect on the stress relaxation.

The metal structure according to the embodiment can be manufactured by the manufacturing method described above.

As described above, according to the method of manufacturing the metal structure of the present invention, in addition to the heat treatment temperature, the Larson-Miller parameter is optimized, and thus it is possible to manufacture the metal structure capable of greatly reducing the stress relaxation rate.

In addition, according to the metal structure of the present invention, coarsening of the grains is suppressed in comparison to the Ni electroforming of the related art, and thus it is possible to improve the mechanical properties such as the Young's modulus, the yield stress, and the Vickers hardness.

In addition, according to the method of manufacturing a metal structure of the present invention, a manufacturing technology of a highly precise small-sized component is applicable to a spring component, and thus accuracy of a device (for example, a timepiece), which uses the highly precise component, is also improved. In addition, since the method of manufacturing a metal structure according to the present invention adopts electroforming, the metal structure can be designed more flexibly in shape. Therefore, the method makes a mechanism or miniaturization, which is not attained by a material in the related art, possible.

In addition, the metal structure according to the present invention is applicable to an assembly component of a mechanical timepiece. For example, the metal structure may be adopted as a spring component for a chronograph mechanism. In addition, in a case of using the metal structure as a chronograph coupling lever spring among spring components, a spring unit is deformed during standby and is released during use of the chronograph mechanism. However, stress relaxation resistance properties are excellent, and thus the component is not likely to plastically deform, and it is possible to provide a timepiece with high accuracy.

EXAMPLES

Next, the present invention will be described in more detail with reference to Examples, but the present invention is not limited to conditions used in the following Examples.

First, an electroforming mold was formed according to the method shown in FIG. 4A to FIG. 4C. When forming the electroforming mold, a Si substrate having a thickness of 525 μm was used as a substrate, and an Au electrode was employed as an electrode.

Next, electroformed materials (metal structures) formed from a Ni—Fe alloy having compositions shown in Table 1 (Conditions 0 to 15 in Table 1) were manufactured by the electroforming device 20 shown in FIG. 5A and FIG. 5B, and by using the electroformed mold that was obtained. In addition, "Condition 0" shown in Table 1 represents a Ni electroformed body (Comparative Example), and represents an example of performing electroforming without adding "ferrous sulfamate pentahydrate" as a source of Fe in the electroforming bath. In addition, the Fe content in Table is measured by a fluorescent X-ray analyzer and represents a mass ratio of Fe when Ni+Fe equals 100.

Hereinafter, an electroforming bath composition of and electroforming conditions will be described.

(Electroforming Bath Composition)

Nickel sulfamate tetrahydrate: 200 g/L to 300 g/L

Nickel chloride hexahydrate: 2 g/L to 10 g/L

Ferrous sulfamate pentahydrate: 5 g/L to 50 g/L

Boric acid: 10 g/L to 50 g/L

Surfactant: 0.1 g/L to 10 g/L

Primary brightening agent: 1 g/L to 15 g/L

Secondary brightening agent: 0.05 g/L to 5 g/L

Antioxidant: 0.1 g/L to 10 g/L pH: 2 to 4

Bath temperature: 40° C. to 60° C.

(Electroforming Conditions)

Negative electrode current density: 1 A/dm$^2$ to 10 A/dm$^2$

Electroforming time: 320 minutes (when the negative current density is 4 A/dm$^2$)

A surface of the metal structure (thickness: 220 μm) that was obtained was polished up to 200 μm and was finished to a mirror surface, the metal structure was taken out from the electroforming mold, and a heat treatment was performed under conditions shown in Table 1. In addition, a metal structure of "Condition 1" represents an electroforming example (Comparative Example) without performing the heat treatment.

[Table 1]

Next, with respect to the metal structures (Condition 0 to Condition 15), a stress relaxation rate, the Young's modulus, a yield stress, Vickers hardness, a maximum grain size, a lattice constant, and a full width at half maximum were obtained. Results are shown in Table 1, and FIGS. 6 to 14. "Condition 0" in Table 1 represents an example (Comparative Example) manufactured by Ni electroforming. In addition, "Condition 1" represents an example (Comparative Example) in which electroforming was performed without performing the heat treatment process after electroforming. However, in FIGS. 6 to 14, a LMP of "Condition 1 (as electroformed)" was originally zero, and an examination was conducted by comparison with an electroformed material after another heat treatment on the assumption that the heat treatment was performed at room temperature (25° C.) for 3 hours and the LMP was 4910.

In addition, data relating to respective properties shown in Table 1 were measured by adopting a chronograph coupling lever spring of a mechanical timepiece as an example of the metal structure constituted by an electroformed material. In addition, "variation rate (%) of a lattice constant" in Table 1 represents a variation rate of a lattice constant in a case of setting a lattice constant of "Condition 1" as a reference.

In addition, datapoints in FIGS. 6 to 14 corresponds to Conditions 0 to 15, or extracts from Conditions 0 to 15 in Table 1. "Lower than 275° C." and "275° C. or higher" in FIGS. 6 to 9 represent heat treatment temperatures.

The stress relaxation rate was obtained by the following Expression (2) conforming to "Method of stress relaxation test for plates for springs" of JIS B2712 2006. With regard to test conditions, deformation was applied with respect to a spring unit of the chronograph coupling lever spring with a constant displacement amount for 48 hours in a thermostatic bath in which the temperature thereof was 80° C. In addition, in Expression (2), 60 represents an initial strain (mm) and $\delta_t$ represents a permanent strain (mm) that remains after releasing a load.

$$\text{Stress relaxation rate (\%)}=(\delta_t/\delta_0)\times 100 \quad (2)$$

A load-displacement curve of the spring unit of the chronograph coupling lever spring was created, and then the Young's modulus was obtained from a gradient of an elastic deformation region.

In addition, with regard to the yield stress, a deformation amount with respect to the spring unit was increased for each one cycle of a repetitive bending test, and the maximum stress in a deformation amount when a load became zero before the spring unit returned to an initial position was set as a necessary yield stress by analysis. In addition, in the embodiment, the load was measured by pressing a distal end of the spring unit of the chronograph coupling lever spring by using a terminal mounted on a load cell, and the displacement amount was measured by a laser displacement meter.

The Vickers hardness was obtained by measuring a surface of the metal structure at three points using a micro Vickers hardness meter and by calculating an average of the resultant measurement values.

In addition, the maximum grain size was obtained by observing a cross-section of the spring unit of the chronograph coupling lever spring using a focused ion beam (FIB).

Figure 6:
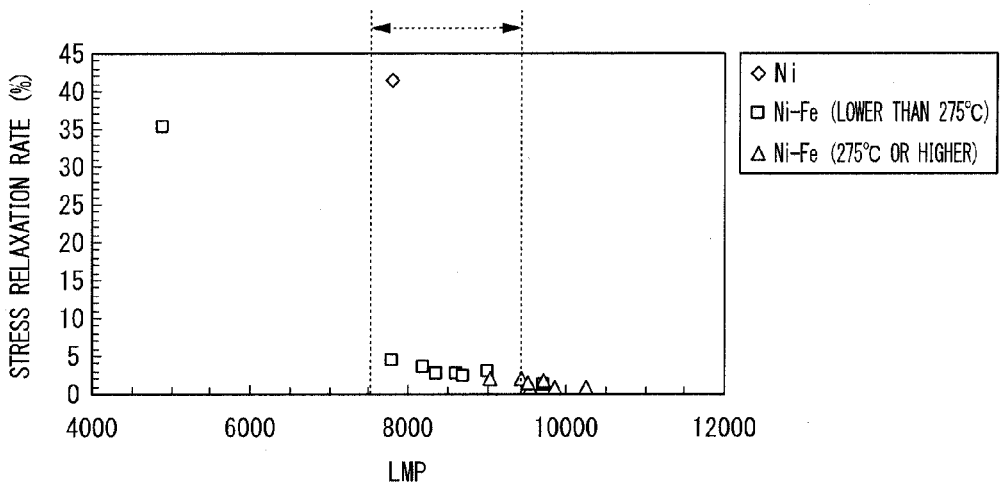
FIG. 6 is a graph illustrating a relationship between LMP and stress relaxation rate in Examples.

FIG. 6 shows a relationship between the LMP and the stress relaxation rate.

As can be seen from a graph of FIG. 6, in a case of the metal structure obtained by the Ni—Fe electroforming, the stress relaxation rate before the heat treatment (Condition 1) was 35%, but when the heat treatment was performed under conditions in which LMP was 7500 or more, the stress relaxation rate was reduced to 5% or less. In addition, when comparing the Ni electroforming and the Ni—Fe electroforming which were subjected to the heat treatment at the same LMP, it could be seen that in the case of the Ni—Fe electroforming, the stress relaxation rate could be reduced to approximately 1/10.

Figure 7:
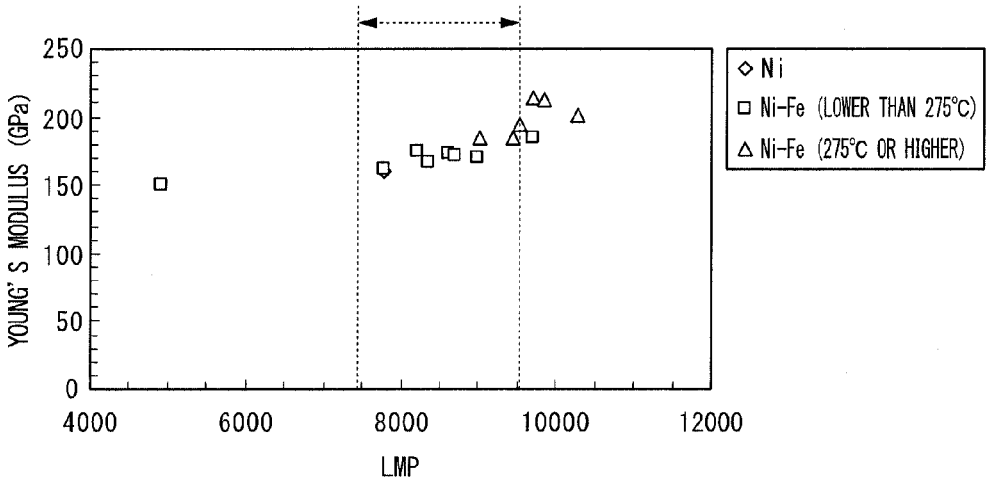
FIG. 7 is a graph illustrating a relationship between LMP and Young's modulus in Examples.

FIG. 7 shows a relationship between the LMP and the Young's modulus.

As can be seen from a graph of FIG. 7, the Young's modulus before the heat treatment was approximately 150 GPa, and exhibited an increase tendency due to the heat treatment and was saturated at the LMP of 9000 to 9500. In addition, the Young's modulus tended to rapidly increase in the vicinity of the LMP of 9500, but in reversal, the Young's modulus switched into a decrease tendency at the LMP of 9500 or more. In addition, in the Ni electroforming and the Ni—Fe electroforming which were subjected to the heat treatment at the same LMP, the Young's modulus was substantially the same in each case.

Figure 8:
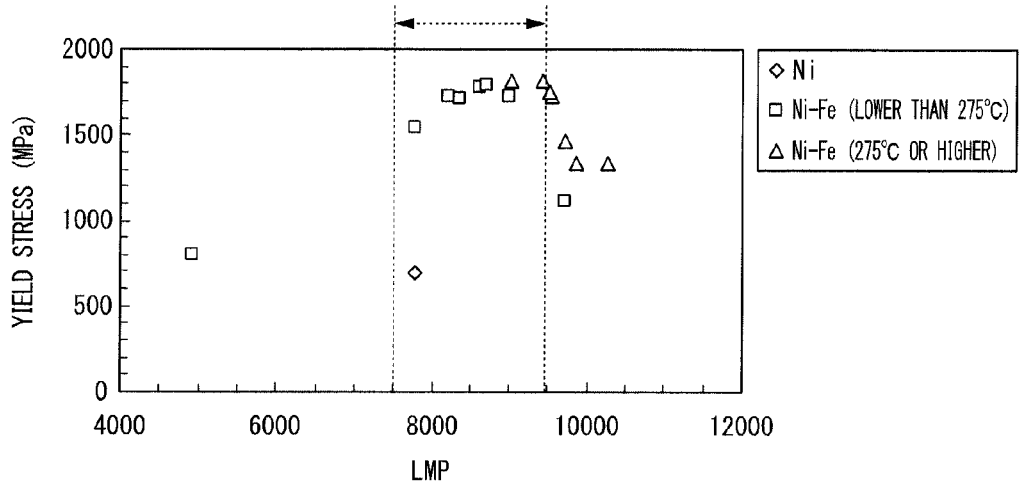
FIG. 8 is a graph illustrating a relationship between LMP and yield stress in Examples.

FIG. 8 shows a relationship between the LMP and the yield stress.

As can be seen from a graph of FIG. 8, the yield stress before the heat treatment was 800 MPa, and the yield stress exhibited an increase tendency due to the heat treatment and was saturated at the LMP of 9000 to 9500. In addition, the yield stress rapidly decreased at the LMP of 9500 or more. When comparing the Ni electroforming and the Ni—Fe electroforming which were subjected to the heat treatment at the same LMP, it could be seen that in a case of the Ni—Fe electroforming, the yield stress increased twice or more. From these results, it could be seen that it is necessary to set the LMP in a range of 7500 to 9500 so as to manufacture a metal structure having the yield stress of 1500 MPa or more.

Figure 9:
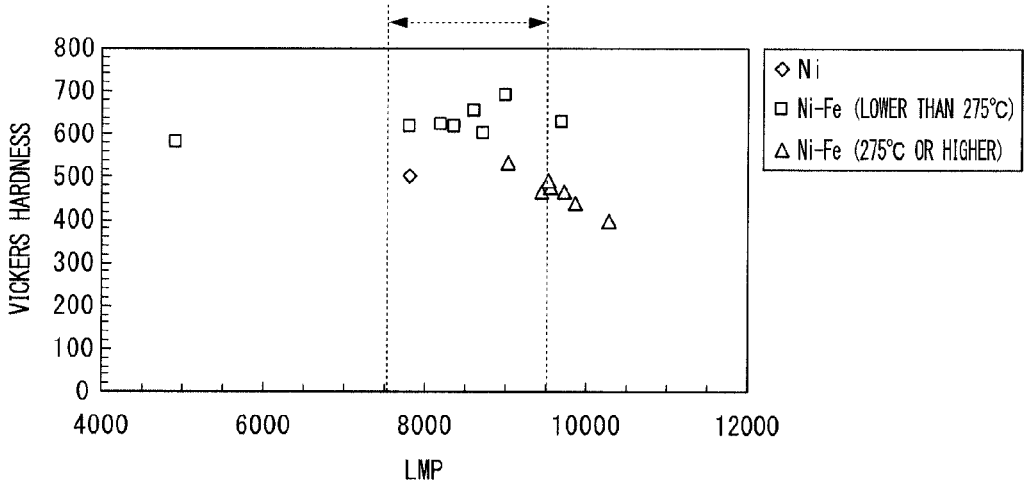
FIG. 9 is a graph illustrating a relationship between LMP and Vickers hardness in Examples.

FIG. 9 shows a relationship between the LMP and the Vickers hardness.

As can be seen from a graph of FIG. 9, the Vickers hardness before the heat treatment was approximately Hv 580, and the hardness increased up to the LMP of 9000 due to the heat treatment. However, in a case where the heat treatment temperature was 275° C. or higher, the Vickers hardness exhibited a decrease tendency. In addition, comparing the Ni electroforming and the Ni—Fe electroforming which were subjected to the heat treatment under the same LMP condition, it could be seen that in a case of the Ni—Fe electroforming, the hardness increased by about 20%.

Figure 10:
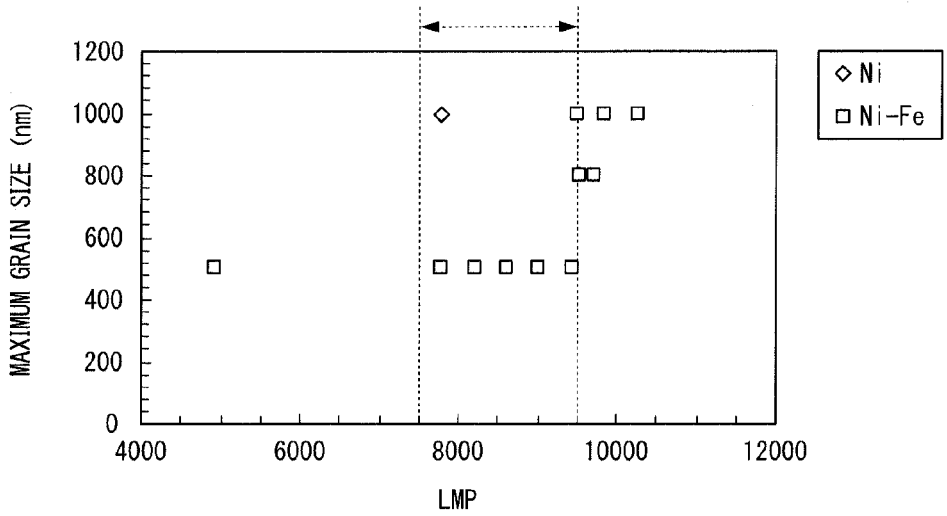
FIG. 10 is a graph illustrating a relationship between LMP and maximum grain size in Examples.

FIG. 10 shows a relationship between the LMP and the maximum grain size.

Up to the LMP of 9500, the maximum grain size was approximately 500 nm without variation, and at the LMP of 9500 or more, grain growth rapidly occurred and the maximum grain size rapidly increased. In addition, when comparing the Ni electroforming and the Ni—Fe electroforming which were subjected to the heat treatment under the same LMP condition, the grain size in the Ni—Fe electroforming was approximately a half of the grain size in the Ni electroforming.

Figure 11:
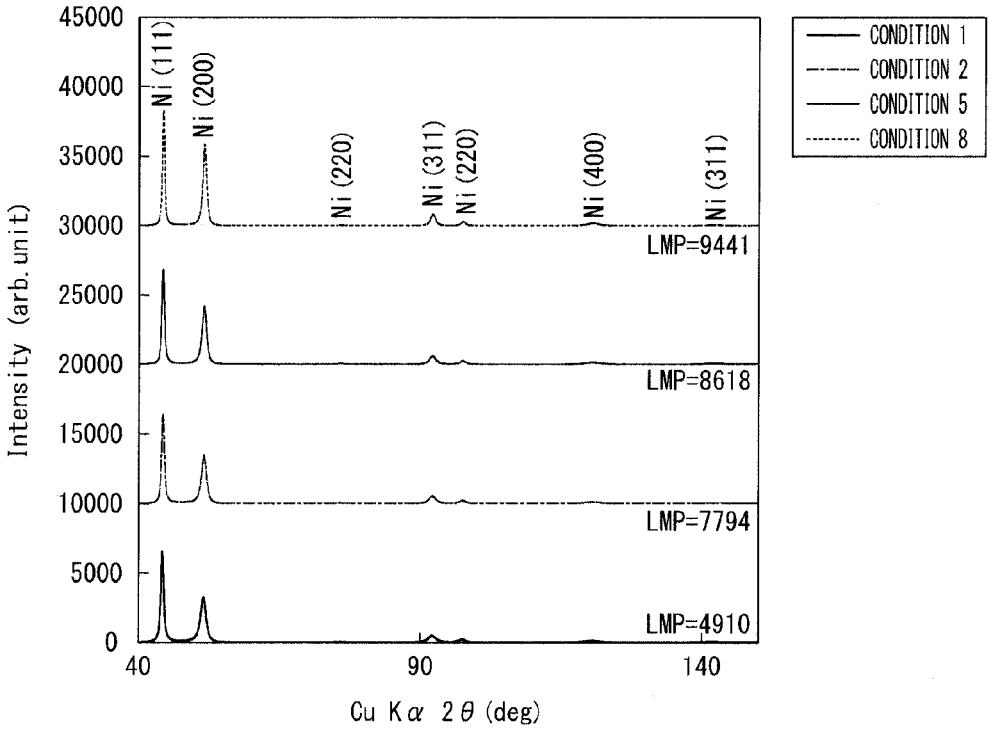
FIG. 11 is an X-ray diffraction pattern of Conditions 1, 2, 5, and 8 in Table 1.

FIG. 11 shows X-ray patterns of Conditions 1, 2, 5, and 8 of Table 1.

As can be seen from FIG. 11, all peaks that were observed related to face-centered cubic lattice of Ni, and Fe completely solid-soluted in the crystal lattice of Ni.

Figure 12:
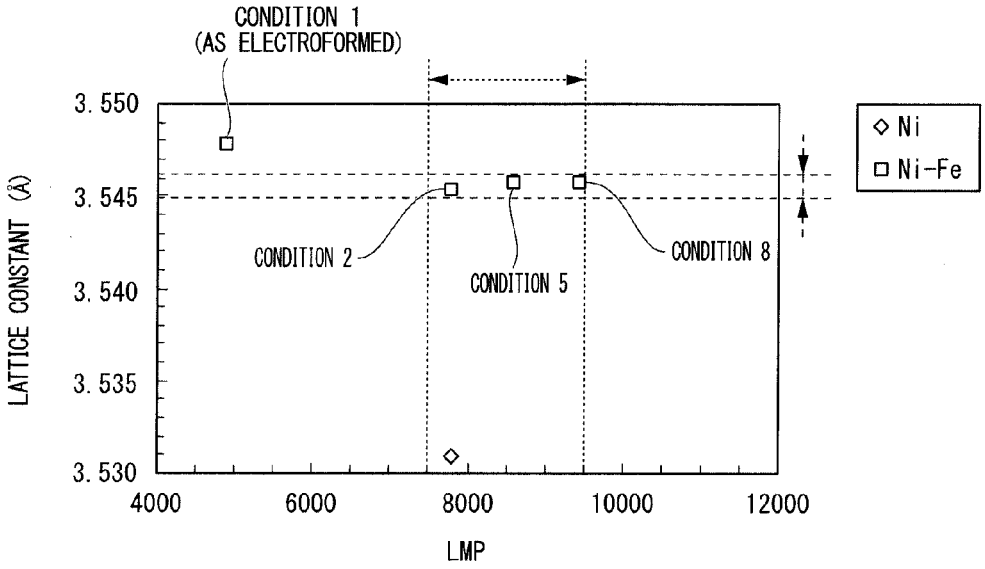
FIG. 12 is a graph illustrating a relationship between LMP and lattice constant obtained from X-ray diffraction pattern of FIG. 11.

FIG. 12 shows a relationship between the LMP and a lattice constants obtained from the X-ray diffraction patterns of FIG. 11 and a lattice constant in Condition 0.

The lattice constant decreased due to the heat treatment, and became approximately constant in a LMP range of 7500 to 9500. In addition, in any case, a variation rate of the lattice constant was 99.95% or less.

Figure 13:
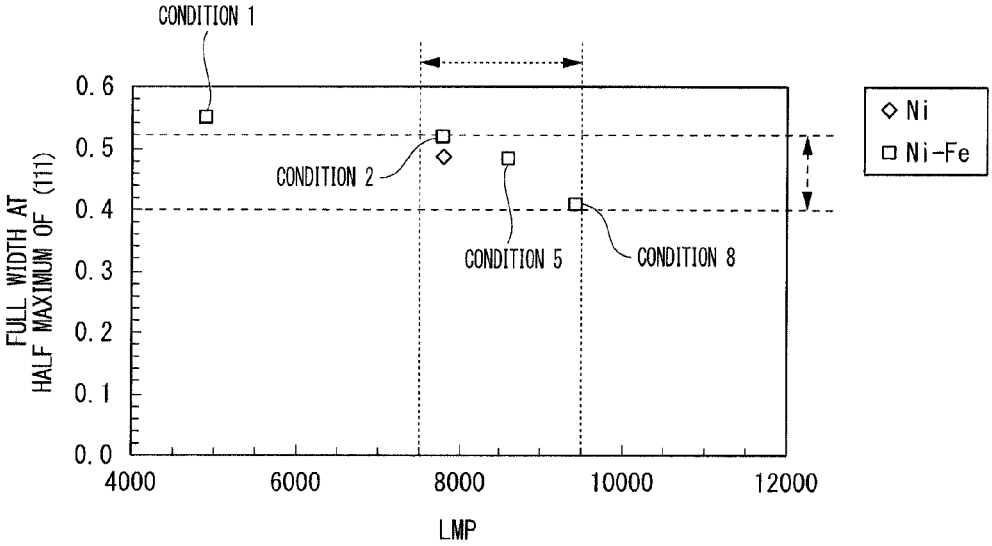
FIG. 13 is a graph illustrating a relationship between LMP and full width at half maximum of (111) plane which is obtained from the X-ray diffraction pattern of FIG. 11.
Figure 14:
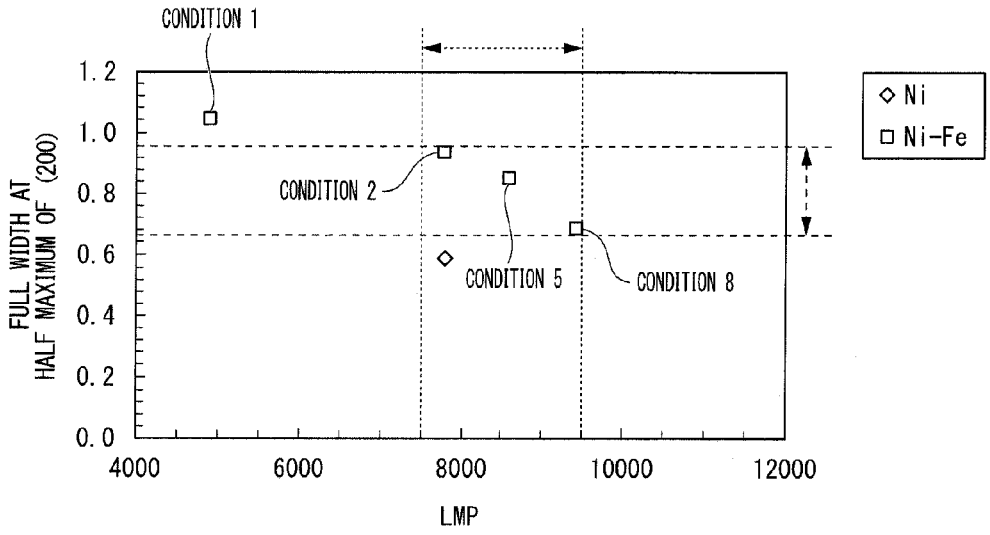
FIG. 14 is a graph illustrating a relationship between LMP and full width at half maximum of (200) plane which is obtained from the X-ray diffraction pattern of FIG. 11.

FIGS. 13 and 14 show a relationship between the LMP and full widths at half maximum of peaks of a (111) plane and a (200) plane which were obtained from the X-ray diffraction patterns of FIG. 11.

It could be seen that the full widths at half maximum of the (111) plane and the (200) plane decreased due to the heat treatment.

EXPLANATION OF REFERENCES

1: Pattern
2: Substrate
3: Electrode (negative electrode)
4: Photoresist
5: Electroformed body
6: Metal structure
7: Electroforming mold

| | ELECTROFORMED MATERIAL (METAL STRUCTURE) | | | HEAT TREATMENT CONDITION | | | FIG. 6 STRESS RELAXATION | FIG. 7 YOUNG'S | FIG. 8 YIELD |
|---|---|---|---|---|---|---|---|---|---|
| No | KIND | Fe CONTENT (MASS %) | S CONTENT (MASS %) | TEMPERATURE (° C.) | TIME (hr) | LMP | RATE (%) | MODULUS (GPa) | STRESS (MPa) |
| CONDITION 0 | Ni | — | 0.058 | 200 | 3 | 7794 | 41.33 | 160 | 693 |
| CONDITION 1 | Ni—Fe | 24.0 | 0.061 | — | — | — | 35.20 | 150 | 800 |
| CONDITION 2 | Ni—Fe | 24.4 | 0.060 | 200 | 3 | 7794 | 4.40 | 161 | 1538 |
| CONDITION 3 | Ni—Fe | 25.1 | 0.059 | 225 | 3 | 8206 | 3.44 | 175 | 1724 |
| CONDITION 4 | Ni—Fe | 25.5 | 0.059 | 250 | 1 | 8368 | 2.68 | 167 | 1707 |
| CONDITION 5 | Ni—Fe | 24.9 | 0.061 | 250 | 3 | 8618 | 2.68 | 174 | 1773 |
| CONDITION 6 | Ni—Fe | 25.4 | 0.057 | 250 | 4.5 | 8710 | 2.29 | 171 | 1788 |
| CONDITION 7 | Ni—Fe | 25.0 | 0.062 | 275 | 3 | 9029 | 2.11 | 184 | 1816 |
| CONDITION 8 | Ni—Fe | 24.6 | 0.058 | 300 | 3 | 9441 | 2.01 | 185 | 1814 |
| CONDITION 9 | Ni—Fe | 26.0 | 0.065 | 300 | 4.5 | 9542 | 0.99 | 194 | 1476 |
| CONDITION 10 | Ni—Fe | 24.2 | 0.057 | 300 | 9 | 9715 | 1.68 | 214 | 1466 |
| CONDITION 11 | Ni—Fe | 24.6 | 0.060 | 325 | 0.83 | 9521 | 1.55 | 194 | 1465 |
| CONDITION 12 | Ni—Fe | 26.1 | 0.060 | 325 | 3 | 9853 | 0.83 | 213 | 1332 |
| CONDITION 13 | Ni—Fe | 25.3 | 0.061 | 350 | 3 | 10265 | 0.75 | 201 | 1335 |
| CONDITION 14 | Ni—Fe | 25.0 | 0.057 | 225 | 120 | 9003 | 2.828 | 170 | 1723 |
| CONDITION 15 | Ni—Fe | 25.0 | 0.059 | 250 | 360 | 9705 | 1.305 | 185 | 1115 |

-continued

| No | FIG. 9 VICKERS HARDNESS | FIG. 10 MAXIMUM GRAIN SIZE (nm) | FIG. 12 LATTICE CONSTANT (Å) | FIG. 12 VARIATION RATE*[1] OF LATTICE CONSTANT (%) | FIG. 13 FULL WIDTH AT HALF MAXIMUM (111) | FIG. 14 FULL WIDTH AT HALF MAXIMUM (200) | REMARKS |
|---|---|---|---|---|---|---|---|
| CONDITION 0 | 500 | 1000 | 3.5309 | | 0.4860 | 0.5904 | COMPARATIVE EXAMPLE |
| CONDITION 1 | 580 | 500 | 3.5478 | CRITERIA | 0.5501 | 1.0437 | COMPARATIVE EXAMPLE |
| CONDITION 2 | 616 | 500 | 3.5452 | 99.93 | 0.5189 | 0.9346 | EXAMPLE |
| CONDITION 3 | 621 | 500 | 3.5454 | 99.93 | 0.5109 | 0.9261 | EXAMPLE |
| CONDITION 4 | 617 | 500 | 3.5456 | 99.94 | 0.4875 | 0.8717 | EXAMPLE |
| CONDITION 5 | 654 | 500 | 3.5457 | 99.94 | 0.4808 | 0.8479 | EXAMPLE |
| CONDITION 6 | 601 | 500 | 3.5455 | 99.94 | 0.4823 | 0.8184 | EXAMPLE |
| CONDITION 7 | 531 | 500 | 3.5455 | 99.94 | 0.4546 | 0.7942 | EXAMPLE |
| CONDITION 8 | 466 | 500 | 3.5457 | 99.94 | 0.4074 | 0.6788 | EXAMPLE |
| CONDITION 9 | 478 | 800 | 3.5456 | 99.94 | 0.4152 | 0.6409 | COMPARATIVE EXAMPLE |
| CONDITION 10 | 467 | 800 | 3.5458 | 99.94 | 0.3953 | 0.6553 | COMPARATIVE EXAMPLE |
| CONDITION 11 | 489 | 1000 | 3.5458 | 99.94 | 0.4330 | 0.7138 | COMPARATIVE EXAMPLE |
| CONDITION 12 | 437 | 1000 | 3.5456 | 99.94 | 0.3714 | 0.5973 | COMPARATIVE EXAMPLE |
| CONDITION 13 | 399 | 1000 | 3.5458 | 99.94 | 0.3458 | 0.5206 | COMPARATIVE EXAMPLE |
| CONDITION 14 | 692 | 500 | 3.5456 | 99.94 | 0.4384 | 0.7678 | EXAMPLE |
| CONDITION 15 | 630 | 1000 | 3.5457 | 99.94 | 0.3776 | 0.6022 | COMPARATIVE EXAMPLE |

IN TABLE 1, UNDERLINED PARTS REPRESENT DEVIATION FROM A RANGE OF THE INVENTION.
*[1]REPRESENTS A VARIATION RATE (%) OF A LATTICE CONSTANT IN A CASE OF SETTING A LATTICE CONSTANT OF "CONDITION 1" AS A CRITERIA.

The invention claimed is:

1. A metal structure comprising, by mass %:

Fe: 10% to 30%;

S: 0.005% to 0.2%; and the balance consisting of Ni and unavoidable impurities, wherein a maximum grain size of the metal structure is 500 nm or less, and wherein a stress relaxation rate of the metal structure is 10% or less.

2. The metal structure according to claim 1, wherein a lattice constant of the metal structure is 3.535 Å to 3.56 Å.

3. The metal structure according to claim 1, wherein a yield stress of the metal structure is 1500 MPa or more and a Young's modulus of the metal structure is 150 GPa or more.

4. The metal structure according to claim 1, wherein a Vickers hardness of the metal structure is Hv 580 or more.

5. A spring component which is formed by the metal structure according to claim 1.

6. A timepiece which uses the spring component according to claim 5 as a component thereof.

7. The metal structure according to claim 2, wherein a yield stress of the metal structure is 1500 MPa or more and a Young's modulus of the metal structure is 150 GPa or more.

8. The metal structure according to claim 2, wherein a Vickers hardness of the metal structure is Hv 580 or more.

9. The metal structure according to claim 3, wherein a Vickers hardness of the metal structure is Hv 580 or more.

10. The metal structure according to claim 7, wherein a Vickers hardness of the metal structure is Hv 580 or more.

11. A spring component which is formed by the metal structure according to claim 2.

12. A spring component which is formed by the metal structure according to claim 3.

13. A spring component which is formed by the metal structure according to claim 4.

14. A spring component which is formed by the metal structure according to claim 7.

15. A spring component which is formed by the metal structure according to claim 8.

16. A method of manufacturing a metal structure, the method comprising:

forming by an electroforming a metal structure including, by mass %,

Fe: 10% to 30%;

S: 0.005% to 0.2%; and the balance consisting of Ni and unavoidable impurities; and performing a heat treatment to the metal structure under conditions in which a heat treatment temperature is 140° C. to 350° C. and a Larson-Miller parameter is in a range from 7500 to 9500.

17. The method of manufacturing a metal structure according to claim 16, wherein the heat treatment temperature is equal to or higher than 140° C. and lower than 275° C.

18. A chronograph coupling lever for a timepiece, the chronograph coupling lever comprising:

a spring component, wherein the spring component includes a metal structure, wherein the metal structure includes by mass %, Fe: 10% to 30%, S: 0.005% to 0.2%, and the balance consisting of Ni and unavoidable impurities, and wherein a maximum grain size of the metal structure is 500 nm or less.

19. A timepiece comprising:

a chronograph coupling lever having a spring component which uses the chronograph coupling lever for a timepiece, wherein the spring component includes a metal structure, wherein the metal structure includes by mass %, Fe: 10% to 30%, S: 0.05% to 0.2%, and the balance consisting of Ni and unavoidable impurities, and wherein a maximum grain size of the metal structure is 500 nm or less.

* * * * *